United States Patent [19]

Ilfrey et al.

[11] 4,147,221

[45] Apr. 3, 1979

[54] RISER SET-ASIDE SYSTEM

[75] Inventors: William T. Ilfrey; Joe K. Heilhecker; Leo D. Maus, all of Houston, Tex.

[73] Assignee: Exxon Production Research Company, Houston, Tex.

[21] Appl. No.: 821,853

[22] Filed: Aug. 4, 1977

Related U.S. Application Data

[63] Continuation-in-part of Ser. No. 732,835, Oct. 15, 1976, abandoned.

[51] Int. Cl.[2] ..... E21B 15/02

[52] U.S. Cl. ..... 175/7; 166/367; 166/339

[58] Field of Search ..... 175/578, 910; 166/0.5, 166/0.6, 367, 339, 341, 350, 365, 340; 61/68, 110, 111

[56] References Cited

U.S. PATENT DOCUMENTS

| | | | |
|---|---|---|---|
| 2,984,308 | 5/1961 | Bauer et al. | 175/7 |
| 3,166,123 | 1/1965 | Watkins | 166/0.6 |
| 3,196,958 | 7/1965 | Travers et al. | 175/7 |
| 3,215,202 | 11/1965 | Pollard et al. | 166/0.5 |
| 3,236,302 | 2/1966 | Postlewaite | 175/7 |
| 3,265,130 | 8/1966 | Watkins | 166/0.6 |
| 3,302,709 | 2/1967 | Postlewaite | 166/340 |
| 3,308,881 | 3/1967 | Chan et al. | 166/340 |
| 3,313,345 | 4/1967 | Fischer | 175/7 X |
| 3,486,555 | 12/1969 | Vincent | 175/7 X |
| 3,547,189 | 12/1970 | Bielstien | 166/0.5 |
| 3,741,296 | 6/1973 | Murman et al. | 166/0.6 |
| 3,789,921 | 2/1974 | De Chassy | 175/9 |
| 3,981,369 | 9/1976 | Bokenkamp | 175/5 |
| 3,996,756 | 12/1976 | Schirtzinger | 175/9 X |

*Primary Examiner*—Ernest R. Purser
*Assistant Examiner*—Richard E. Favreau
*Attorney, Agent, or Firm*—Gary D. Lawson; R. L. Graham

[57] ABSTRACT

A marine riser system for use in deep water drilling operations from a floating vessel is disclosed. The riser system permits detachment of the lower end of the riser from the wellhead enabling the riser to be set aside to a position which is clear of the wellhead. Support means adjacent the wellhead can be used to support and position the riser when it is set aside. Tensioners, support mechanisms and guidance means are provided to move the riser back and forth between the wellhead and support means. In this manner, casing and tools having diameters larger than that of the riser can be inserted into the wellhead without returning the riser to the surface. Drilling operations with large diameter drill bits can also be conducted with the riser in the set aside position.

40 Claims, 25 Drawing Figures

RISER SET-ASIDE SYSTEM

CROSS REFERENCE TO RELATED APPLICATIONS

This application is a Continuation-In-Part of the United States Patent application Ser. No. 732,835 filed Oct. 15, 1976 now abandoned.

BACKGROUND OF THE INVENTION

1. Field of the Invention

This invention relates to offshore operations conducted from a floating vessel. More specifically, this invention relates to an improved marine riser system for use in drilling oil wells and similar boreholes from floating vessels.

2. Description of the Prior Art

In recent years the search for oil and gas has extended into increasingly deeper waters. Economic considerations and physical limitations frequently militate against the use of bottom supported platforms in very deep water. Therefore, most offshore drilling in deep water is conducted from a floating drilling vessel which supports the drill rig and derrick and associated drilling equipment.

A riser pipe is normally used to interconnect the floating vessel and the wellhead. A drill string extends from the floating vessel, through the riser and into the wellhead located on the sea floor. The riser pipe serves to guide the drill string into the wellhead and to conduct returning drilling fluid back to the vessel during drilling operations in the annulus between the riser pipe and drill string. The marine riser is presently regarded as the limiting element in floating drilling operations since the weight of the riser pipe and the stresses within the pipe increase with water depth. Adding to the stress on the riser pipe are bending moments caused by the action of wind, wave and sea currents on the riser and by movements of the drilling vessel.

To counteract riser stress, riser tensioning devices are normally mounted on the drill ship. These tensioning devices apply a constant tensile force to the top of the riser pipe, thereby reducing bending stresses on the riser. The use of flexible joints placed intermediate the ends of the riser has also been suggested to increase riser flexibility. However, both riser tensioning devices and flexible joints have their limitations as to the amount of riser stress which they can relieve.

In ordinary drilling using conventional risers, the riser pipe is about 17 to 20 inches in diameter. The relatively large diameter of the riser pipe is necessary to permit the drill bit or other large diameter tools used in connection with setting the casing to pass through the riser pipe. However, if a smaller diameter riser (12 to 15 inch inside diameter) can be used, the overall weight of the riser would be less, significantly reducing stress on the riser pipe.

The main problem with a small diameter riser is that it has to be retrieved every time it becomes necessary to run casing or tools into the well which have a diameter or width larger than the inside diameter of the riser. Complete retrieval of the riser is called a riser trip and each such trip can take from two to twenty days depending on water depth, weather conditions and other factors. If two or three riser trips are required during a drilling operation in deep water, as much as 40 days of expensive rig time can be lost. Thus, there is a need for a deep water drilling system which permits the use of small diameter risers without the concomitant loss of rig time caused by riser trips.

SUMMARY OF THE INVENTION

An object of the present invention is to eliminate the need to return a marine riser to the surface every time drill pipe, casing, or well tools having diameters larger than the inside diameter of the riser have to be placed into a subsea well. The present invention can also be used when it is necessary to change or modify the blowout preventer stack. Rather than returning the riser to the surface, the riser pipe system of the present invention permits the riser to be set aside by moving it to a position which is clear of the wellhead, thereby permitting insertion of tools into the well or modification of wellhead apparatus.

In one embodiment of the present invention a riser system includes a riser pipe having its upper end connected to a floating drilling vessel and its lower end detachably connected to a subsea wellhead or to a subsea support means positioned adjacent the wellhead. Means are provided for detaching the lower end of the riser from the wellhead and for moving it so that the lower end of the riser is in supporting relationship with the support means. Similarly, means are provided for returning the riser to the wellhead position. Means for moving the riser may include tensioners, support mechanisms and guidance means.

Means for supporting the lower end of the riser may include support posts and frames which are capable of structurally distributing the load of the riser. Tensioning means aboard the drilling vessel may be provided to support the upper end of the riser and to maintain it in tension to prevent buckling. Normally, a subsea installation such as a blowout preventer stack connects the riser with the wellhead when the riser is positioned above the wellhead.

In accordance with the method of present invention, a riser pipe initially connected at its upper end to a floating drilling vessel and at its lower end to a subsea wellhead is disconnected from the wellhead. The riser is then set aside by moving it to a position which is away from the wellhead and placing the riser on support means located adjacent the wellhead. This procedure may be reversed to reconnect the riser to the wellhead. Suitable support means may also be provided to permit the riser and blowout preventer stack to be set aside or to permit only the riser to be set aside. Suitable support means may also be in drilling locations where sea currents are sufficiently strong, the riser can be set aside by disconnecting the lower end of the riser and allowing the lower end to drift a safe distance downcurrent from the wellhead.

The method and apparatus of the present invention permits the efficient use of lighter, smaller diameter risers in deep water. When it becomes necessary to remove the riser to run casing, to insert large diameter drilling bits or tools, or to change the blowout preventer stack, the riser can be disconnected from the wellhead and set aside on the support means or allowed to drift, thereby eliminating a time consuming riser trip. The riser set aside system of the present invention therefore has significant advantages over systems existing heretofore.

DESCRIPTION OF THE PREFERRED EMBODIMENT

Figure 1:
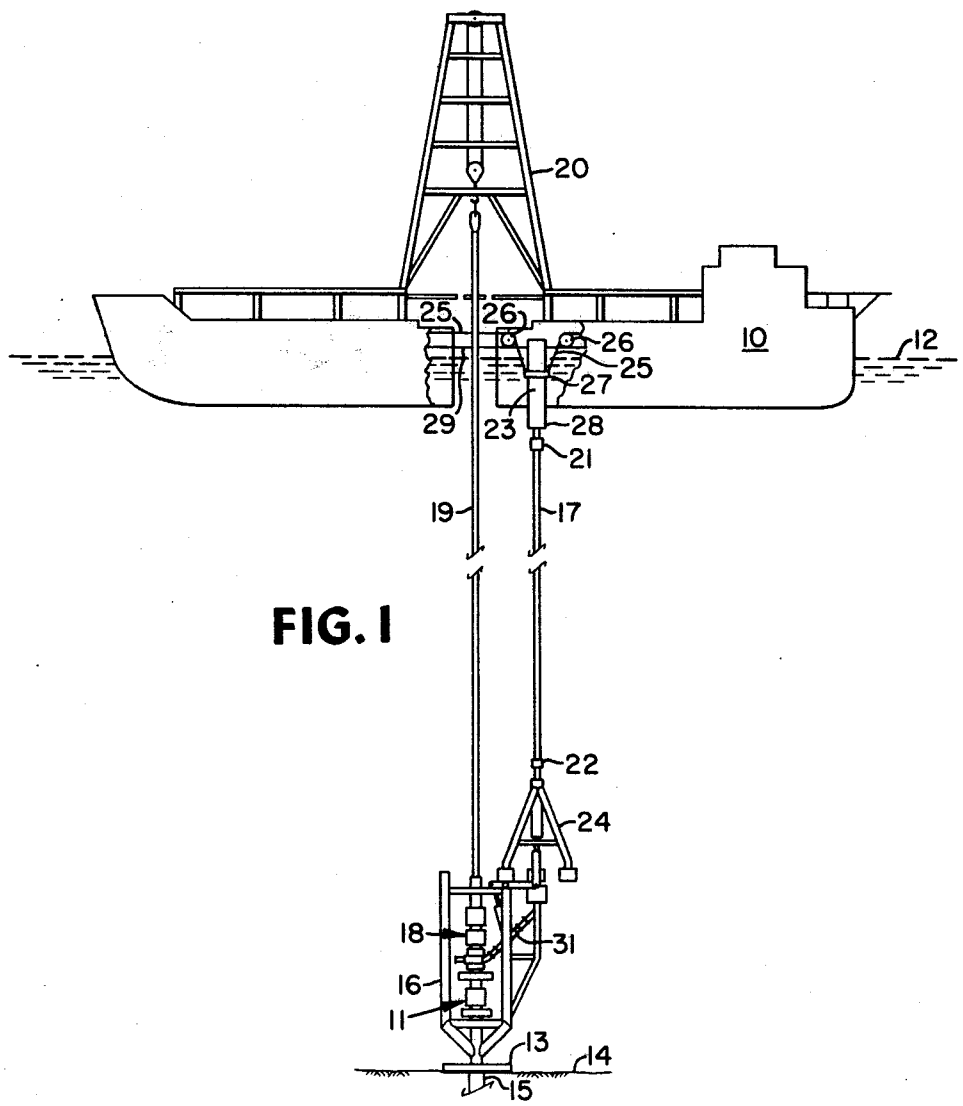
FIG. 1 is a schematic elevational view partly in section showing floating drilling equipment including the riser system of the present invention in the set aside position.

FIG. 1 shows the riser system of the present invention for use with a floating drilling vessel 10 and a subsea wellhead 11. Drilling vessel 10 is shown floating on a body of water 12. As illustrated, guide base 13, rests on the sea floor 14 and supports frame 16 which in turn supports marine riser 17 and blowout preventer stack 18 (hereinafter referred to as BOP stack). Drill pipe 19 extends from derrick 20 aboard drilling vessel 10, down through BOP stack 18 and into wellbore 15.

For purposes of illustration, one embodiment of present invention will be described in connection with the drilling of a subsea well. The description will include the drilling of a 26 inch diameter hole for 20 inch structural casing, a $17\frac{1}{2}$ inch diameter hole for $13\frac{3}{8}$ inch surface casing, and a $12\frac{1}{4}$ inch diameter hole for $9\frac{5}{8}$ inch standard casing. However, as will become apparent the riser set aside concept may be used for other types of drilling operations and procedures.

Riser 17 is shown in the set aside mode, the operation of which will be explained later. The term "set aside" mode or position, as used herein, means the riser is offset from its customary operating position above wellhead 11. The riser has flexible joints 21 and 22 attached respectively to its upper and lower ends. Upper joint 21 connects the upper end of the riser to a vertically extensible slip joint 23 and lower joint 22 connects the lower end of the riser to riser frame 24 which provides load distribution for the riser induced loads. Lower joint 22 lessens the transfer of moments from the riser to the riser frame, thus allowing the riser to flex when the drilling vessel is deflected from the centerline of the wellbore by wind or wave action. Large diameter ball joints and steel-elastomer flex joints have been found to make particularly effective flexible joints for this purpose, but any flexible joint capable of withstanding high tensile loads is satisfactory. In addition to the upper and lower joints 21 and 22, a series of joints (not shown) positioned between the ends of riser 17 may be used to increase riser flexibility.

Tensioners (not shown) acting through cables 25 maintain riser 17 in tension and prevent it from buckling. Each cable passes over a pulley 26 and attaches to outer barrel clamp 27 which in turn is attached to outer barrel 28 of slip joint 23. Slip joint 23, being vertically extensible, compensates for vessel heave, thereby preventing excessive stresses in the riser. The tensioning system imparts a tensile load to slip joint 23 which is transmitted to the whole riser pipe string which includes riser 17, joints 21 and 22, slip joint 23 and frame 24. The tensioners may be hydraulically or pneumatically actuated and may reel cables 25 in and out in response to the vertical motion of vessel 10, thus maintaining approximately constant tensile load on riser 17.

Pulleys 26 rest upon guides 29 and permit the riser pipe string to be laterally moved. Movement of the pulleys along the rail guides alters the tensioning of cables 25, forcing the riser pipe string to be displaced laterally in the direction of pulley movement. Tension is maintained at all times through cable 25 while the riser is being moved. When it is necessary to maintain the riser in a stationary position pulleys 26 are locked in place.

The purpose for initially placing riser 17 in the set aside position is to permit the installation of large diameter surface casing without the use of a correspondingly large diameter riser. For example drill pipe 19 can be used to drill a 26 inch diameter hole through BOP stack 18. Drilling fluids, circulated down through the drill pipe in a conventional manner, return from the wellbore and are diverted into riser 17 by means of diverter line 31 located on the BOP stack. Since riser 17 is only used as a return conduit for the drilling fluid it need not have a large diameter. Thus riser 17 can be lighter weight, small diameter riser having an inside diameter of about 13 inches.

Figure 2:
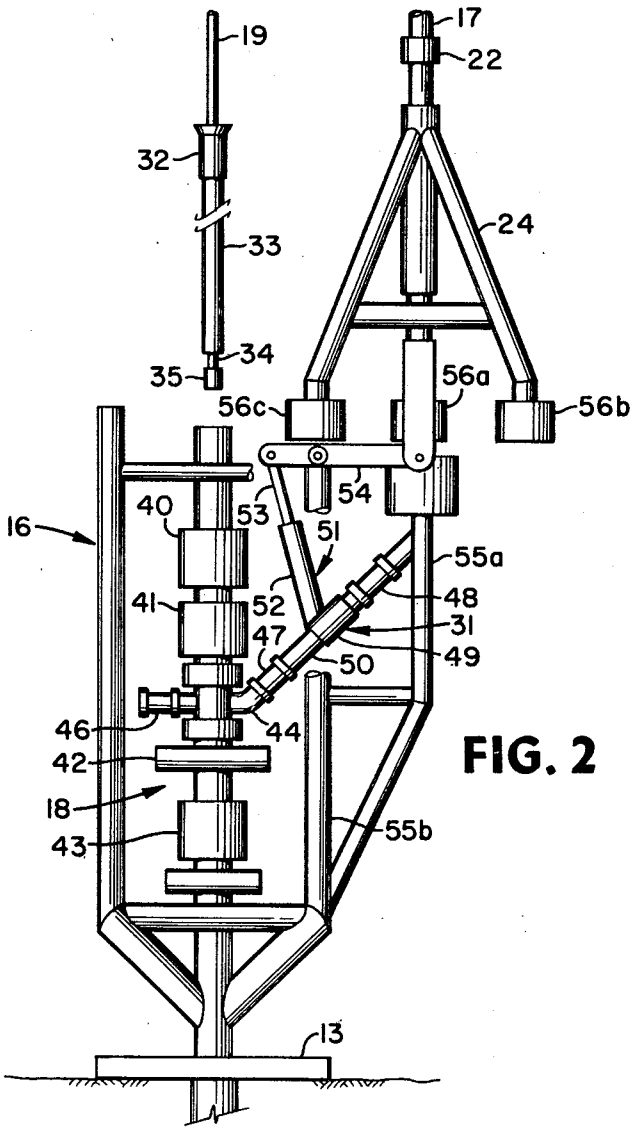
FIG. 2 is an enlarged view of the wellhead and lower end of the riser shown in FIG. 1, illustrating details of the support frame, blowout preventer stack, and wellhead.

After the 26 inch hole is drilled to a depth of from about 500 to 1500 feet, 20 inch surface casing can be installed and cemented in place. The casing installation is schematically depicted in FIG. 2 which also shows a more detailed view of stack isolation frame 16, BOP stack 18 and riser frame 24. Drill pipe 19, carrying wellhead housing 32, is used to run casing 33 through BOP stack 18 and into wellbore 15. Also shown are stinger 34 and cement shoe 35 which are conventional equipment used to assist the cementing of casing 33.

BOP stack 18 is a large diameter, low pressure diverter stack. Such a stack normally has a working pressure of about 500 psi and would be used only for the installation of conductor and surface casing. As illustrated in FIG. 2, the stack consists of two annular preventers 40 and 41, a blind shear ram 42, and a hydraulic connector 43. The BOP stack also includes crossover spool 44 which diverts fluid flow from the BOP stack into diverter line 31, Dump valve 46 is provided to permit rapid expulsion of fluids from the BOP stack in the event of an emergency. During normal operation, drilling fluids will be diverted by crossover spool 44 through valve 47 into diverter line 31. Closing off annular preventers 40 or 41 will prevent fluids from flowing up through BOP stack 18. Alternatively, other sealing means such as a rotating seal can be employed to shut off flow to BOP stack 18.

Diverter line 31 may perform additional important functions besides diverting the flow of drilling mud into the riser. As shown in FIG. 2, diverter line 31 further includes throttling valve 48 and hydraulic flowline connector 49. Throttling valve 48 is used to regulate and maintain wellbore pressure. Hydraulic flowline connector 49 contains a telescopic piston 50 which inserts into and connects with valve 47 after the BOP stack has been lowered in place. Connector 49 may also provide control functions for the riser lift mechanism 51.

Riser lift mechanism 51 consists of a hydraulic cylinder 52 and piston (not shown), connecting rod 53 and lifting arm 54. Control lines (not shown) within connector 49 control the actuation of the lift mechanism which provides guidance and lift assistance in moving riser 17 to and from the set aside position.

Figure 5:
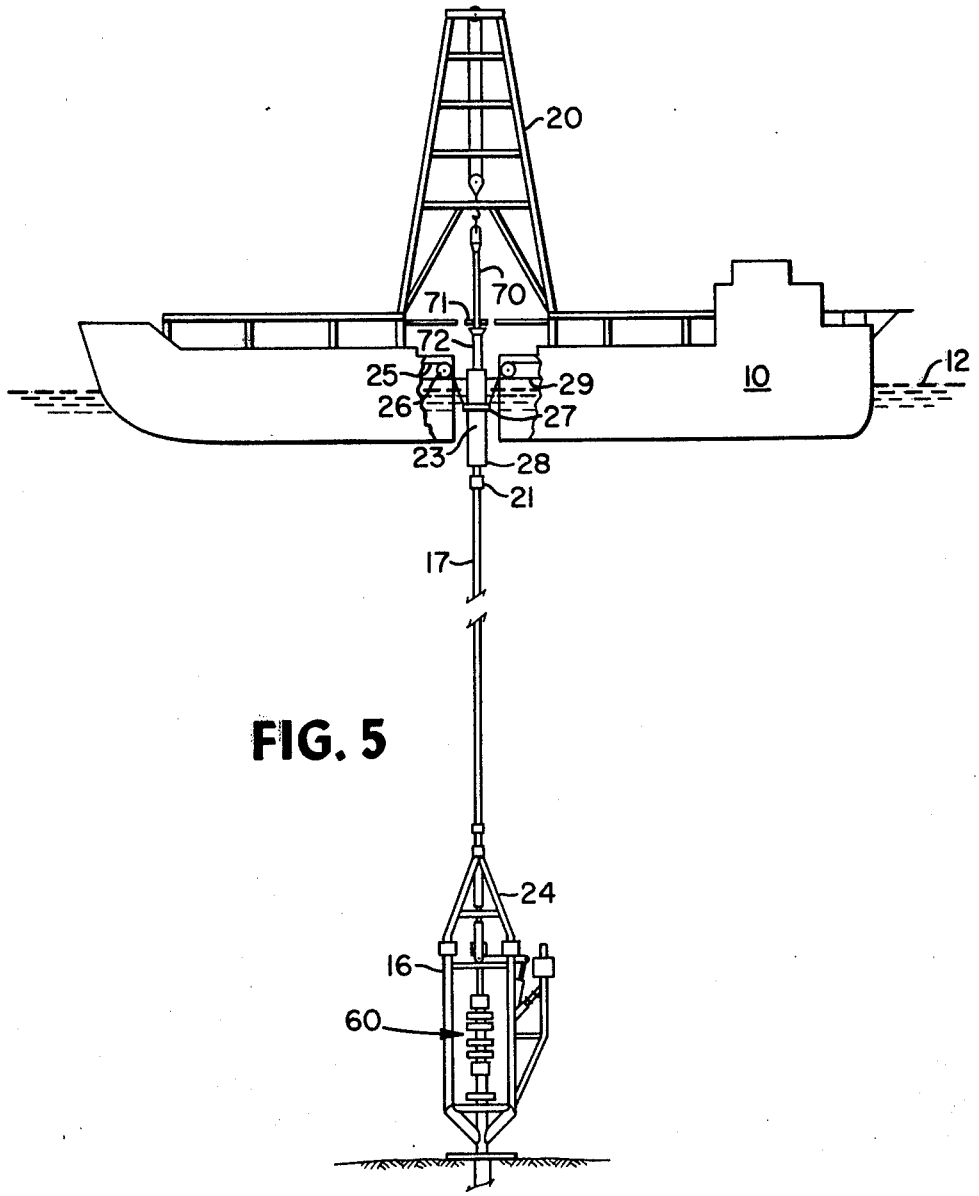
FIG. 5 is a schematic elevational view partly in section showing floating drilling equipment including the riser system of the present invention in the conventional drilling position.

Also shown in FIG. 2 are riser frame 24 and a cutaway view of frame 16 which provides support for BOP stack 18 and riser 17. Frame 16 is designed to distribute riser induced loads into the structural casing below guide base 13. When the riser is positioned on top of the BOP stack (as shown in FIG. 5) a major portion of the load induced by the riser are removed from the BOP clamp and connector by the isolation frame 16, thus maintaining full pressure integrity within the BOP stack. In the set aside position shown in FIG. 2, the riser loads are distributed by riser frame 24 into support posts 55*a* and 55*b*. (A third support post is not in view). Connection of the frame into the posts is made by hydraulic connectors 56*a* and 56*c* and a third connector (not shown).

Once the 20 inch surface casing is in place, a 17½ inch hole can then be drilled and cased with 13⅜ inch casing to a depth of from about 2000 to 4000 feet. This phase of the drilling operation would also be completed with riser 17 in the set aside mode. After the 13⅜ inch casing has been run and cemented, the drilling operations can be converted to the conventional mode with riser 17 positioned above BOP stack 18.

Figure 3:
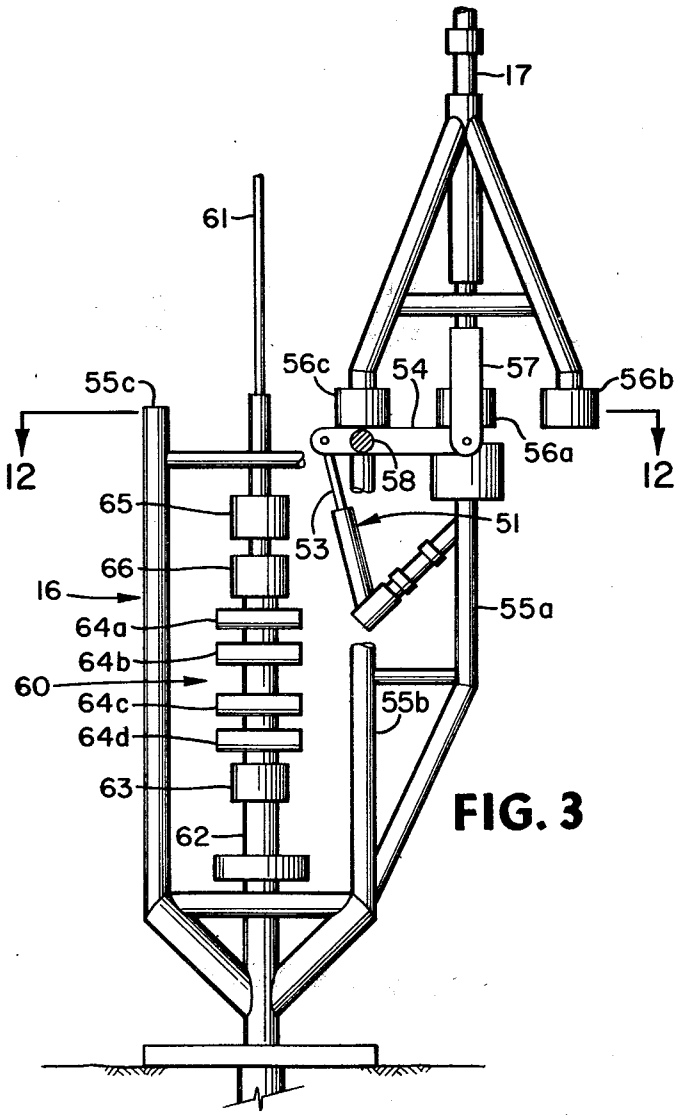
FIG. 3 is an enlarged view of the lower end of the riser in the set aside position, illustrating installation of a high pressure blowout preventer stack.

As will be illustrated, the conversion to a conventional drilling mode includes replacing the low pressure BOP stack (shown in FIG. 2) with a high pressure stack (shown in FIG. 3). Drilling the 26 inch and 17½ inch holes for conductor and surface casing can be performed using sea water or a low density mud as the drilling fluid. Because well control is not generally a problem during the initial phases of the drilling operation, a low pressure BOP stack is used. However, when drilling the remainder of the well to its final depth through producing formations it is frequently necessary to use a high pressure BOP stack with the riser in the conventional drilling position to insure that well control will be maintained.

The first step in converting to a conventional drilling mode is to disconnect and retrieve the low pressure BOP stack. A drill pipe is lowered and attached to the top of the BOP stack and then, using remote control actuators, the BOP stack is disconnected from the wellhead and diverter line and returned to the surface on the drill pipe. A high pressure stack is then lowered on the drill pipe and positioned on the wellhead. This is illustrated in FIG. 3 which shows a high pressure BOP stack 60 being attached to the wellhead. The stack is lowered on drill pipe 61 and attached to wellhead connection 62 by means of hydraulic connector 63. Once the BOP stack is in place, drill pipe 61 is detached and raised to the surface. BOP stack 60 is a high pressure stack which permits completion of the well through the producing zones. It normally is designed to operate at pressures as high as 10,000 psi. The stack shown in FIG. 3 consists of four ram type preventers 64 *a, b, c,* and *d* and two annular preventers 65 and 66.

Figure 12:
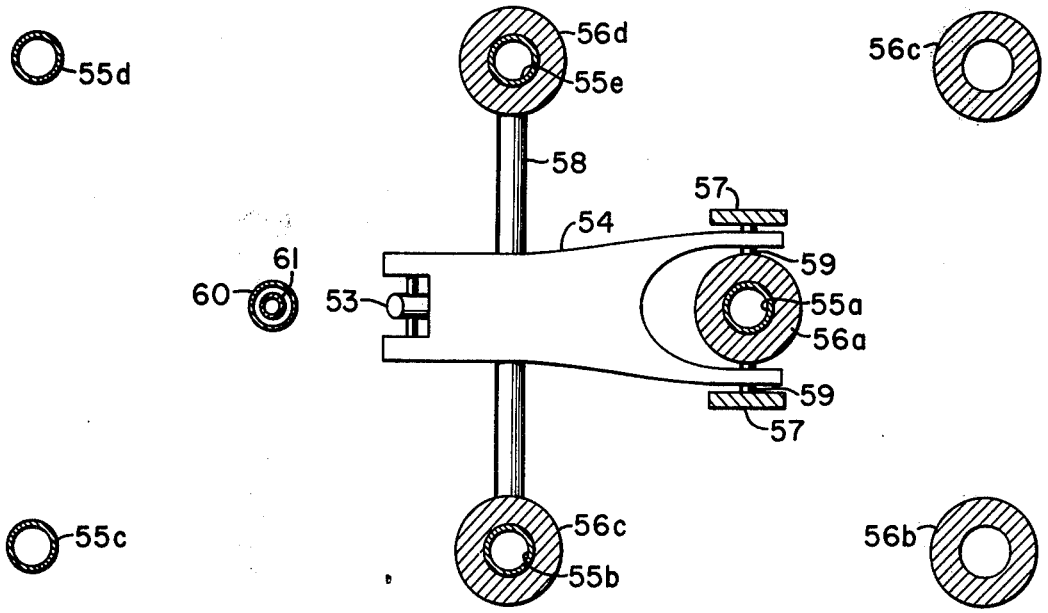
FIG. 12 is a sectional view along line 12—12 of FIG. 3 illustrating the riser in the set aside position.

FIG. 12, which is a sectional view along line 12—12 of FIG. 3, shows the alignment of the riser support at frame 16 when the riser is in the set aside mode. The riser is attached to support post 55*a*, 55*b* and 55*e* by hydraulic connectors 56*a*, 56*c* and 56*d*.

Figure 4:
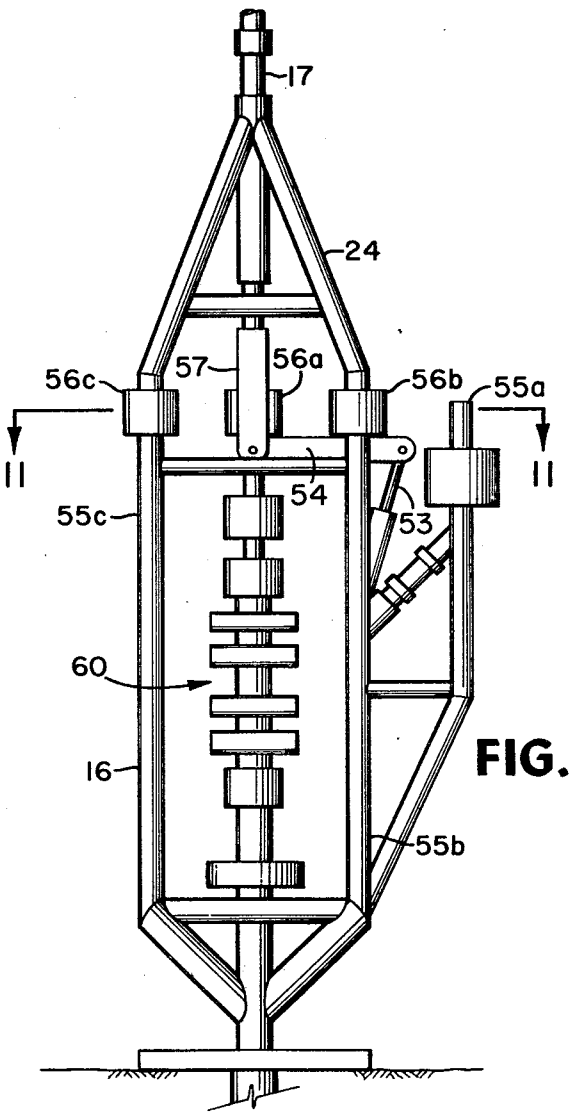
FIG. 4 is an enlarged view of the lower end of the riser, similar to FIG. 3, illustrating the riser position after it has been moved to a position above the blowout preventer stack.
Figure 11:
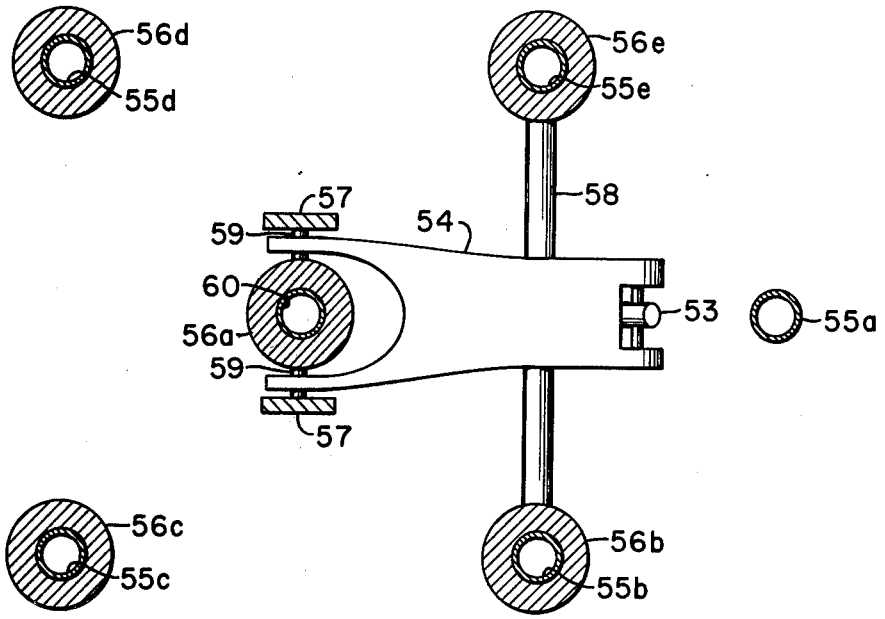
FIG. 11 is a sectional view along line 11—11 of FIG. 4 illustrating the riser aligned above the blowout preventer stack.

With the high pressure BOP stack in place, riser 17 can now be moved from the set aside position (FIG. 3) to the conventional position (FIG. 4) above BOP stack 60. FIG. 11, which is a sectional view along line 11—11 of FIG. 4, shows the alignment of riser and support frame 16 when the riser is in the conventional position. The riser is connected to support posts 55*b*, 55*c*, 55*d* and 55*e* by connector 56*b*, 56*c*, 56*d* and 56*e* and connector 56*a* now attaches to BOP stack 60. Once again, frame 16 transmits the induced riser loads into the subsurface and structural casing, substantially reducing the load on BOP stack 60.

As mentioned above, the riser is returned by detaching hydraulic connectos 56*a*, 56*c* and 56*d*, uplifting the riser and moving it laterally so that it aligns with BOP stack 60, and then lowering the riser and attaching it to the BOP stack and stack isolation frame 16. Means for uplifting and moving the riser may be provided by the shipboard tensioners and pulley system and the riser lift mechanism. As mentioned previously, lift mechanism 51 assists the tensioners in elevating the riser off the stack isolation frame but primarily serves to guide the riser to its proper position above the BOP stack. Hydraulic cylinder 52 retracts connecting rod 53 which is connected to lifting arm 54. As shown in FIGS. 11 and 12, the lifting arm 54 is attached to the riser by pins 59 which are attached to connector 56*a* and connecting member 57. The upper end of the connecting member 57 is rigidly attached to the riser 17. As the riser is moved to the conventional position, lifting arm 54 rotates about support member 58 of frame 16.

Once riser 17 is in the conventional mode shown in FIG. 4, normal drilling operations can be conducted. FIG. 5 schematically illustrates drilling operations from vessel 10 with riser 17 in the conventional position above BOP stack 60. Drilling is conducted through riser 17, the riser serving to house drill pipe 70 and to conduct drilling fluids back to vessel 10 in the annulus between the riser and drill pipe.

As can be seen from FIG. 5, pulleys 26 have been moved along rail guide 29 to reposition riser 17 beneath the rotary table 71 of derrick 20. In addition to outer barrel 28, slip joint 23 includes an inner barrel 72 slidable within the outer barrel. Seal members (not shown) prevent drilling fluid contained within riser 17 from escaping between the inner and outer barrels. Inner barrel 72 is pivotally connected to vessel 10.

In the preferred embodiment of the present invention riser 17 is a small diameter riser having an inside diameter of about 13 inches or less. Thus the well can be completed in a conventional manner by drilling through this riser with a 12¼ inch drill bit and then running and cementing 9⅝ inch casing into the wellbore.

The riser set aside system of the present invention permits the efficient use of small diameter risers by eliminating the need to return the riser to the surface during the entire drilling operation. Eliminating riser round trips saves from two to twenty days depending upon water depth. The resultant saving in riser handling time using the set aside system in deep water can be as much as 40 days.

Small diameter risers weigh considerably less than large diameter risers in deep water and require significantly less tensioning. As illustrated in Table I, which compares riser weight and shipboard tension for 13 inch and 17 inch diameter risers at water depths of 3000 feet and 9000 feet, the differentials are not proportionate to water depth. Reduction in riser weight with the 13 inch riser varies from 100 kips at 3000 feet to 1450 kips at 9000 feet. Thus a three-fold increase in water depth results in greater than a fourteen-fold increase in weight differential. Riser tension necessary to support the riser is reduced 160 kips at 3000 feet and 700 kips at 9000 feet when the smaller diameter riser is used. Thus there is a considerable incentive to use smaller diameter risers in deep water.

TABLE I

| | 13 Inch I.D. Riser | | 17 Inch I.D. Riser | |
|---|---|---|---|---|
| Water Depth (feet) | 3000 | 9000 | 3000 | 9000 |
| Riser Weight (kips*) | 1100 | 4600 | 1200 | 6050 |
| Tension (kips*) | 800 | 1400 | 960 | 2100 |

*kip equals 1000 pounds of force.

Figure 6:
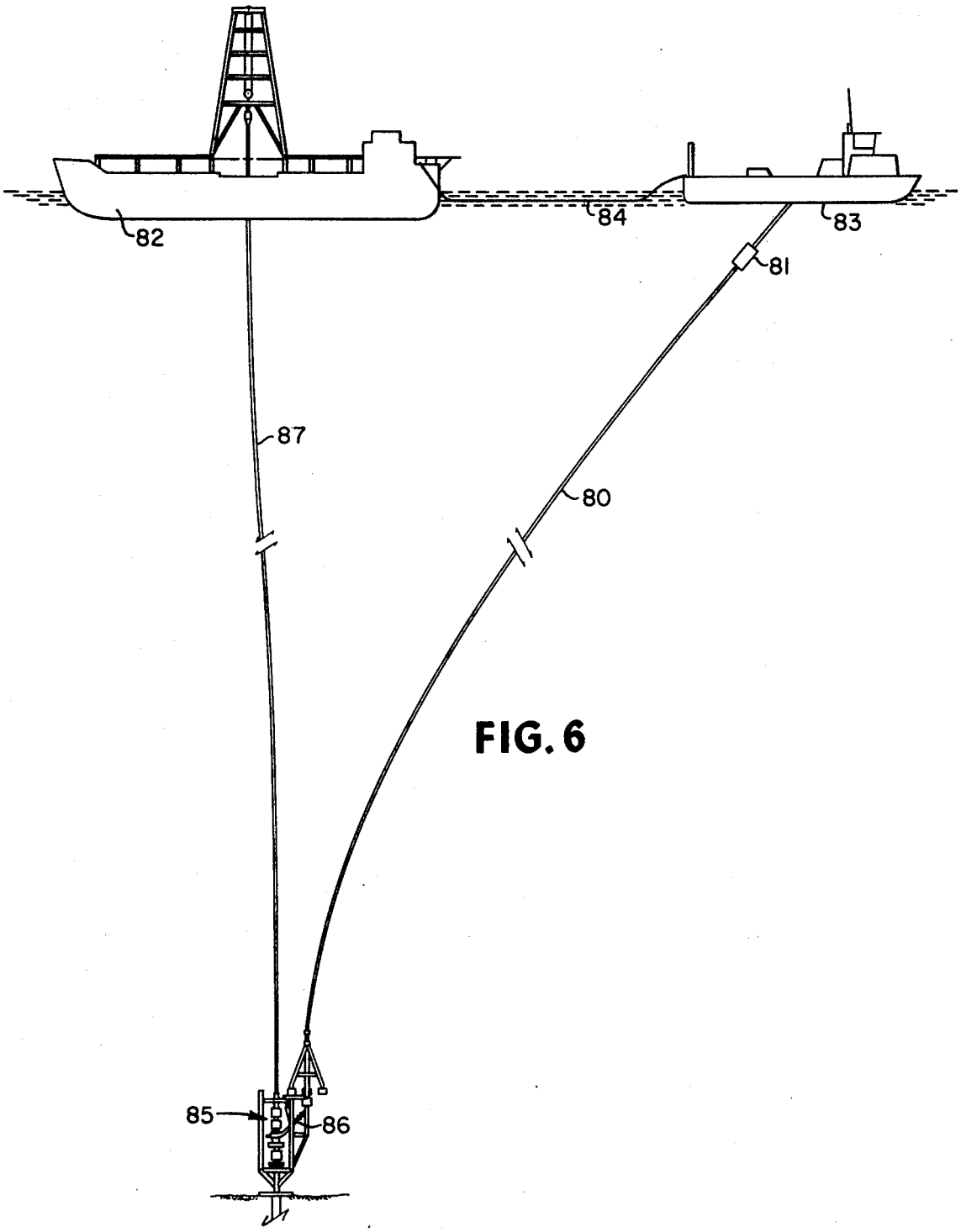
FIGS. 6 and 7 are schematic elevational views of a two-vessel drilling operation using the riser system of the present invention.
Figure 7:
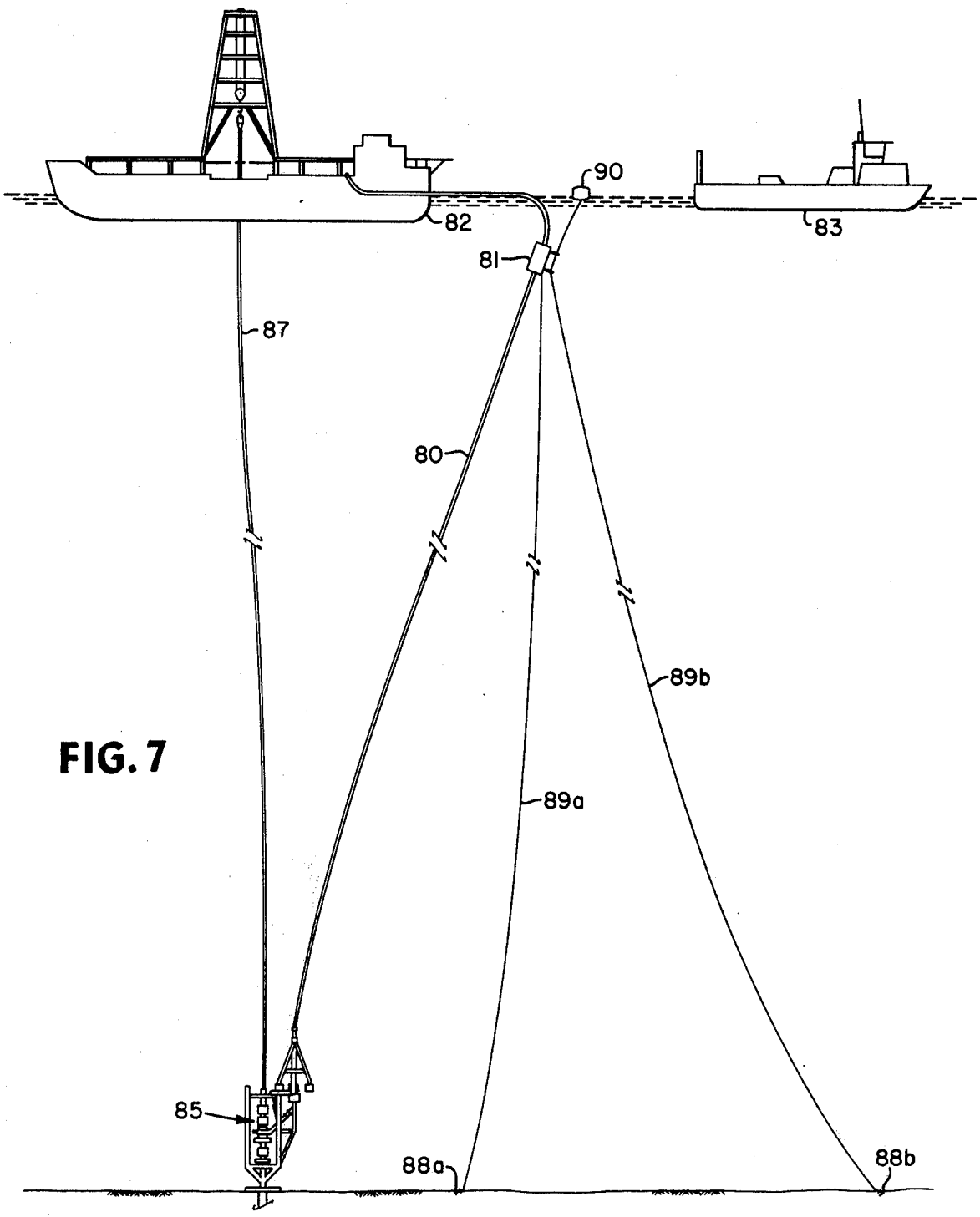

Another embodiment of the present invention is schematically illustrated in FIGS. 6 and 7. In this embodiment marine riser 80 is equipped with an inflatable disconnect platform 81 which is at a distance of about 300 to 500 feet below the surface. Initially drill ship 82 is attached to the riser (e.g., as shown in FIG. 1). The drill ship then pumps air into a conventional disconnect structure 81 until the overall buoyancy of riser 80 permits it to be self standing. The drill ship then disconnects the riser at the disconnect structure and moves sufficiently far away to permit workboat vessel 83 to position itself over riser 80 and connect with it. Drilling fluids are conditioned on vessel 83 and returned to drill ship 82 through umbilical hose bundle 84. Hose bundle 84 may also contain the BOP control and hydraulic lines so that BOP stack 85 can be controlled from the drill ship via vessel 83, riser 80 and diverter line 86.

A further refinement of this embodiment is shown in FIG. 7. Workboat vessel 83 has inserted two anchors **88*a* and 88*b* in the sea floor. Anchor lines 89*a* and 89*b*, respectively attached to anchors 88*a* and 88*b*, are secured at their upper ends to riser disconnect platform 81. Hose bundle 84 is attached directly to the disconnect platform and buoy 90 is positioned above the riser to indicate its location. Once riser 80 is secured in place, workboat vessel 83** may detach from the riser and, as shown, depart to perform other functions.

As illustrated in FIGS. 6 and 7, the two vessel system permits riser 80 to be positioned a safe distance away from drill pipe 87. If swift sea currents are prevalent then the currents will cause bending of both the drill pipe and riser when the riser is in the set aside mode. However, drill pipe 87 being lighter and more flexible than riser 80 will bend a greater distance from the vertical than riser 80. If the riser and drill pipe are closely adjacent; as with a single vessel system (e.g., See FIG. 1), then there exists the possiblility that the bending drill pipe will hit against or interfere with the riser.

Positioning the riser a distance from the drill ship necessitates bending the riser slightly. However, at depths of 9000 feet, it is only necessary to flex the riser at an angle of about 3° from the vertical to permit a 500 foot separation between the top of the riser and drill ship. Naturally, at shallower depths the riser can be positioned closer to the drill ship because there will be less bending of the drill string.

In waters where sea currents are sufficiently strong to move the lower end of the riser, another embodiment of the present invention may be the preferred approach. In this embodiment the support means for the riser is eliminated. A drilling sequence utilizing this embodiment is shown in FIGS. 8 through 10 and is described below.

Figure 8:
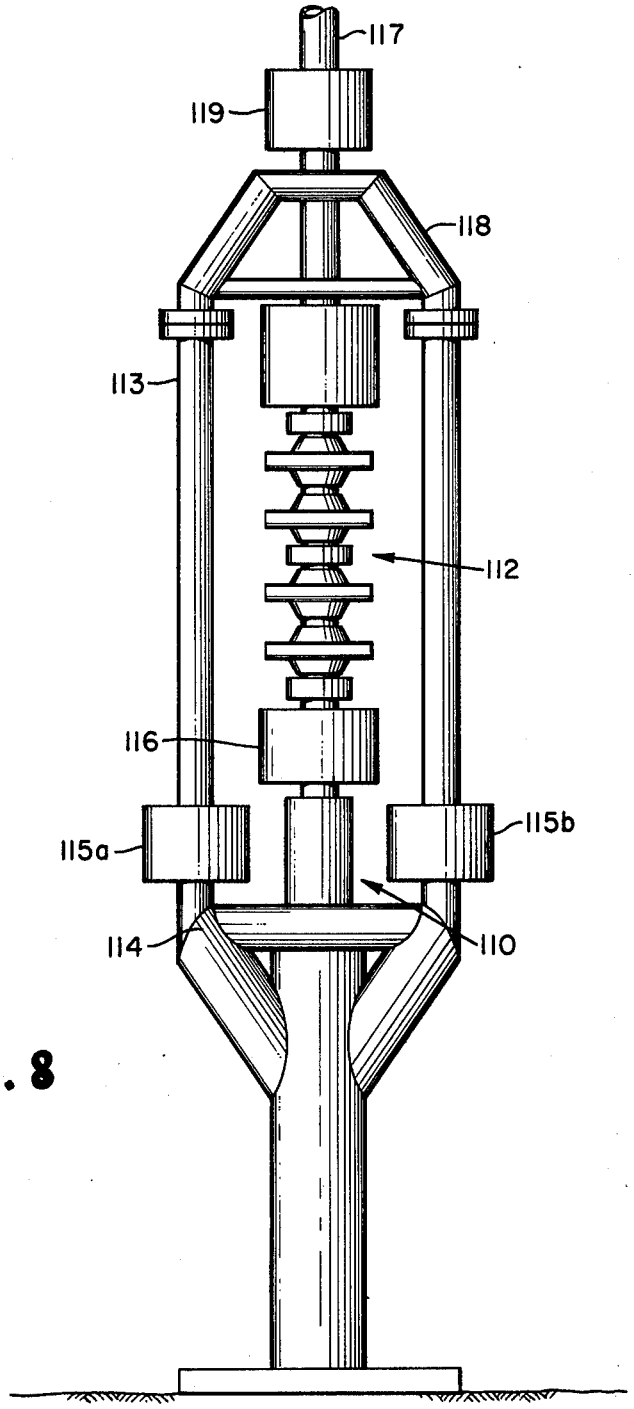
FIG. 8 is an enlarged view of the wellhead, lower end of the riser, and blowout preventer assembly illustrating details of another riser system embodiment of the present invention.

FIG. 8 shows a high pressure, 18¾ inch BOP stack 112 with four ram preventers attached to and supported on wellhead 110. The BOP stack has a support frame 113 which provides the necessary structural support for the BOP stack when it is in a state of tension under riser induced loads. Support frame 113 attaches to wellhead support base 114 by means of four hydraulic connectors **115*a*, 115*b* and two others not in view. Connecting the BOP stack to wellhead 110 is hydraulic connector 116. Riser 117 is supported above BOP stack 112 by riser frame 118 which is part of BOP support frame 113**.

Drilling of the 26 inch hole can proceed by drilling through riser 117 with an underreaming tool. Drilling is conducted in a conventional manner with drilling fluid circulating down through the drill string and back up the riser. Once the 26 inch hole is drilled it is necessary to remove both BOP stack 112 and riser 117 in order to install and cement 20 inch surface casing since both the BOP stack and riser have inside diameters of less than 20 inches.

Figure 9:
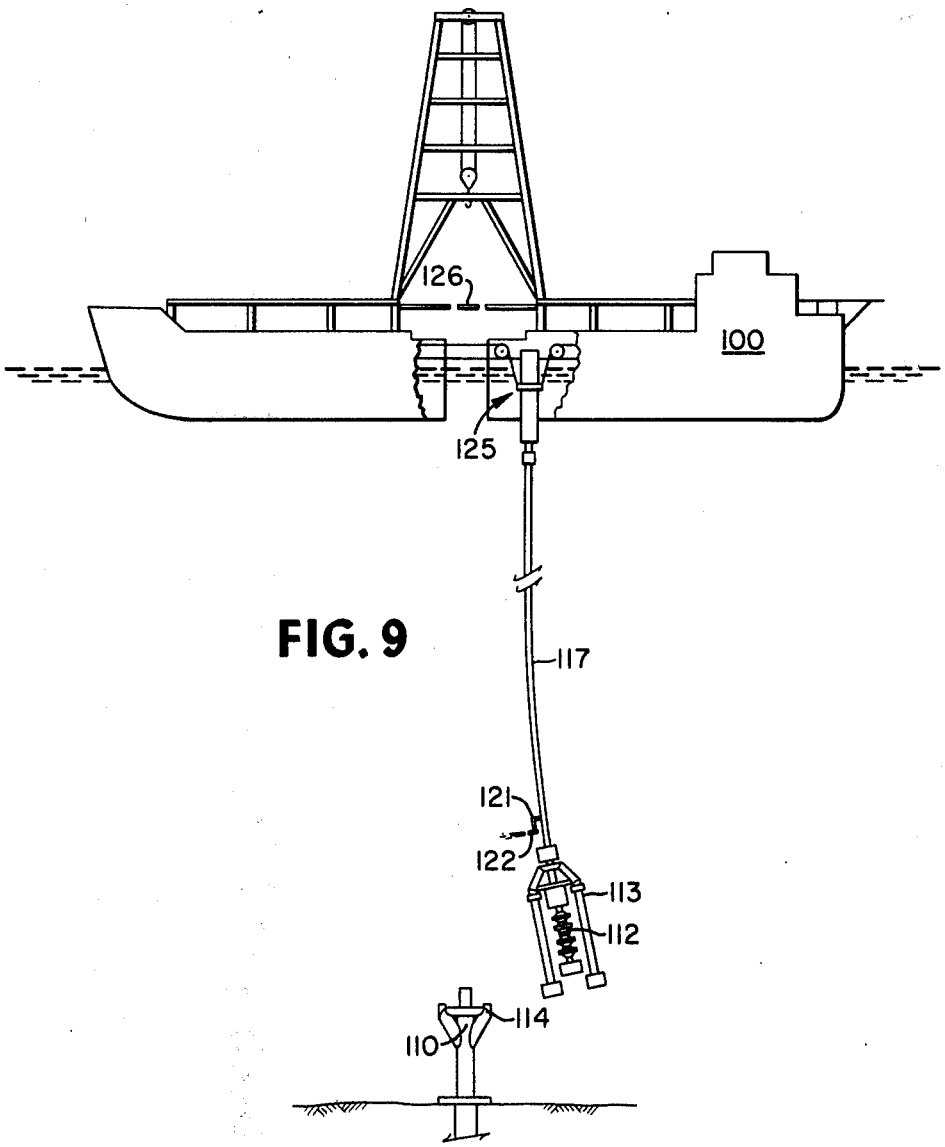
FIGS. 9 and 10 are schematic elevational views depicting operation of the riser system embodiment shown in FIG. 8, illustrating set aside positions of the riser.
Figure 10:
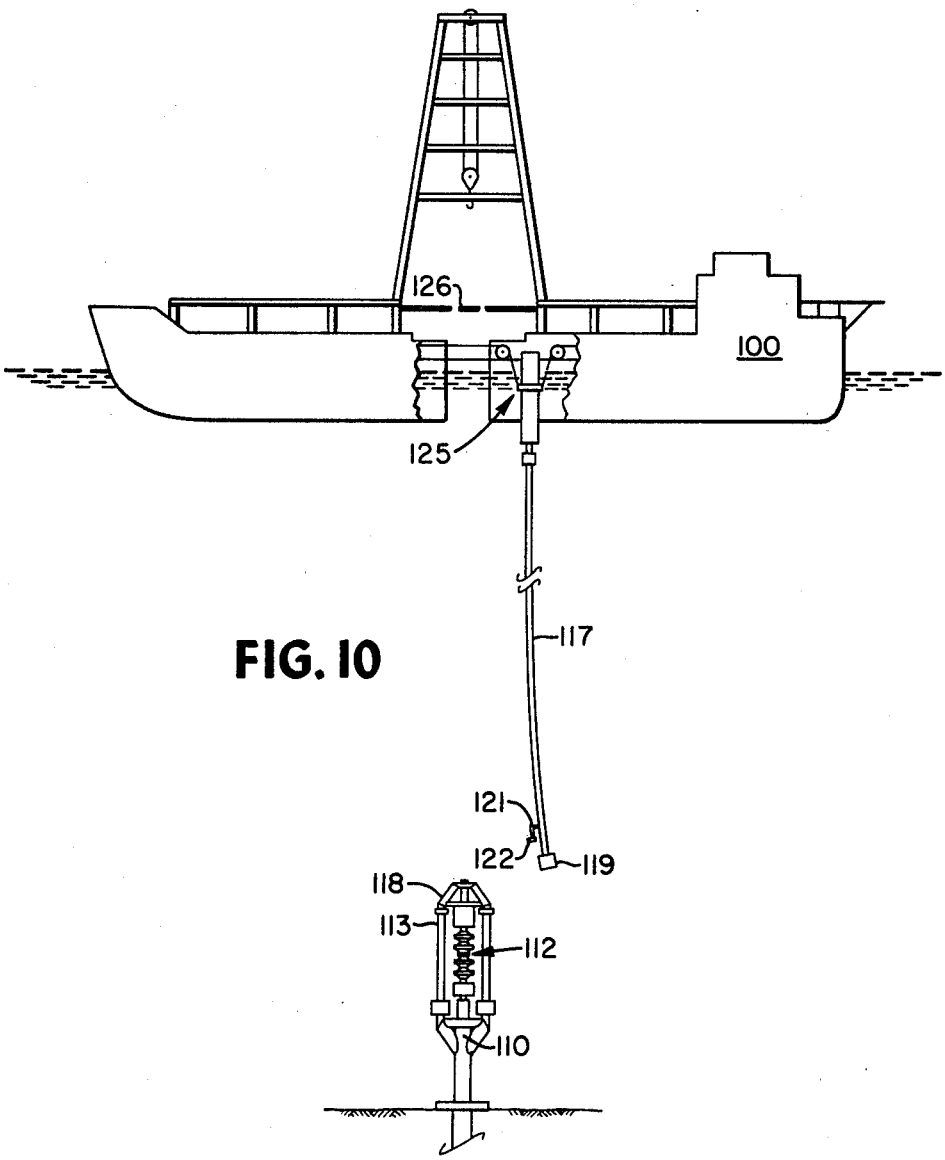

As is illustrated in FIG. 9, the BOP stack and riser is temporarily moved aside by disconnecting the hydraulic connectors which attach BOP stack 112 and its support frame 113 to wellhead 110 and its support base 114. In this manner, the lower end of BOP stack 112 is still attached to riser 117 and riser frame 113.

If sea currents are sufficiently strong near the ocean floor, the BOP stack and lower end of the riser, if uplifted slightly, will drift downcurrent, away from the wellhead. However, the BOP stack and frame, which can weigh as much as 400,000 pounds, may have a substantial anchoring effect on the riser. If sea currents are not strong enough to deflect both the riser and BOP stack a safe distance (several hundred feet) from the wellhead 110, then auxiliary propulsion systems can be employed. For example, as shown in FIG. 9, a thruster system can be deployed at the lower joint of riser 117. Bypass line 121 can be used to divert a fluid, such as sea water, under pressure from the riser into jet nozzle 122. The fluid is ejected from nozzle 122 and helps propel the riser and BOP stack away from the wellhead in the direction indicated. The nozzle should be a steerably rotable nozzle so that the riser can be deflected in any direction.

The upper end of riser 117 is laterally moved on drilling vessel 100 utilizing a pulley and rail guide system (generally indicated by numeral 125) in the manner previously described. Once the upper end of the riser is moved out from under rotary table 126, 20 inch casing can be run (parallel to the riser) down from the drilling vessel and into the well.

After the 20 inch casing has been run into the well and cemented in place, the upper end of the riser is returned to the rotary table. The BOP stack is then reconnected to the wellhead to return it to the configuration shown in FIG. 8. Reconnection can be accomplished by utilizing some of the recently developed guidelineless re-entry systems. For example, systems equipped with sonar, television and altimeters can be incorporated in the subsea structural equipment such as the BOP stack and frame. Displays and readouts transmitted to the surface by the system would indicate how far and in what direction the drilling vessel would have to move in order to compensate for the sea current, thereby permitting positioning of the BOP stack directly over the wellhead. Once in position, the BOP stack is reattached to the wellhead.

After the BOP stack has been reattached to the wellhead, a 17⅜ inch hole is drilled to a depth of about 2000 to 4000 feet by drilling through the riser, again using an underreaming tool and circulating drilling fluids in a conventional manner. To install and cement 13⅜ inch conductor casing in the 17½ hole it is necessary to set the riser aside. Since the BOP stack has a 18¾ inch inside diameter the stack can remain in place during the second casing installation.

As illustrated in FIG. 10, the next step is the disconnection of riser 117 from riser frame 118. This is accomplished by releasing connector 119 and allowing the riser to drift downcurrent a safe distance from the BOP stack and wellhead. Without being weighted down by the BOP stack, the riser should be able to drift a safe distance from the BOP stack without the need for propulsion assistance from nozzle 122. Once again, the upper end of the riser is laterally moved aboard vessel 100 using pulley and rail guide system 125.

After the riser is set aside, 13⅜ inch conductor casing is run into the well from the drilling vessel and then cemented in place. Using the previously described reentry techniques, the riser is then returned to its original position and reattached to the BOP stack. From this point on, the well is completed in a conventional manner since the equipment will pass through a 13 inch diameter riser. The riser can remain in the position shown in FIG. 8 during remaining drilling operations.

The advantage of the above embodiment is that it permits the riser to be set aside without the use of support posts. Furthermore, since all drilling is conducted through the riser using underreaming tools it is not necessary to divert drilling fluids into the riser when in the set aside mode, thereby eliminating the use of a low pressure BOP stack and diverter line. Thus, the riser is only set aside when casing or tools, having a diameter larger than the diameter of the riser or BOP stack, are to be inserted into the well. This embodiment, however, is limited to situations in which sea currents are capable of deflecting the riser a safe distance from the wellhead.

Figure 13:
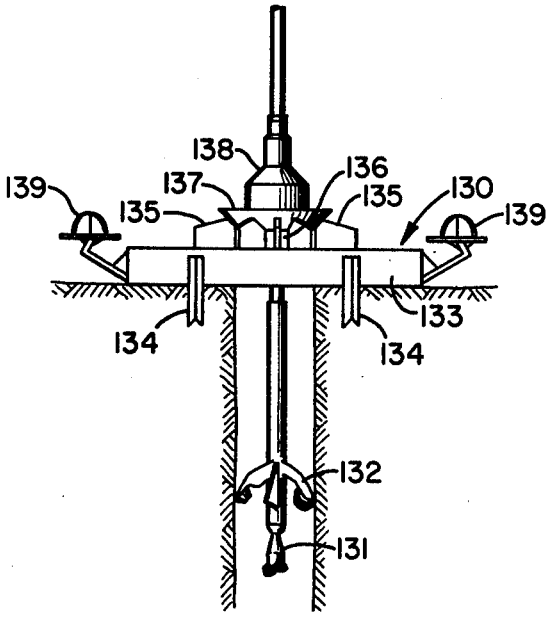
FIG. 13 is a schematic elevational view of apparatus for another embodiment of this invention illustrating a temporary guide base and equipment for drilling a wellbore.

FIGS. 13–25 illustrate another embodiment of this invention wherein both the riser and BOP are set aside. Referring to FIG. 13, the first step in the practice of this embodiment is to lower a temporary guide base 130 from a drilling vessel (not shown) using a conventional double "J" running tool 138 with a pilot bit 131 and a 48 inch underreamer 132. The guide base 130 is defined by base plate 133 with attached toe spikes 134. Support members 135 are arranged about a guide sleeve 136 of the temporary guide base and are attached to the base plate 133. At the uppermost end of the guide sleeve is a flared seat 137 which aids in running drilling tools and casing through sleeve 136. Sonar reflectors 139 are attached to the base plate to further aid in guiding equipment through the sleeve 136. The interior of the guide sleeve 136 includes "J" shaped lug slots (not shown) for engagement with the running tool 138.

A 48 inch bore hole is opened using the pilot bit 131 and the underreamer bit 132. The 48 inch hole is drilled to a sufficient depth to enter a competent formation, typically a depth of about 100 feet. The drilling is desirably accomplished by using sea water as drilling fluid. During drilling with sea water, there generally is no return of cuttings to the floating vessel.

Figure 14:
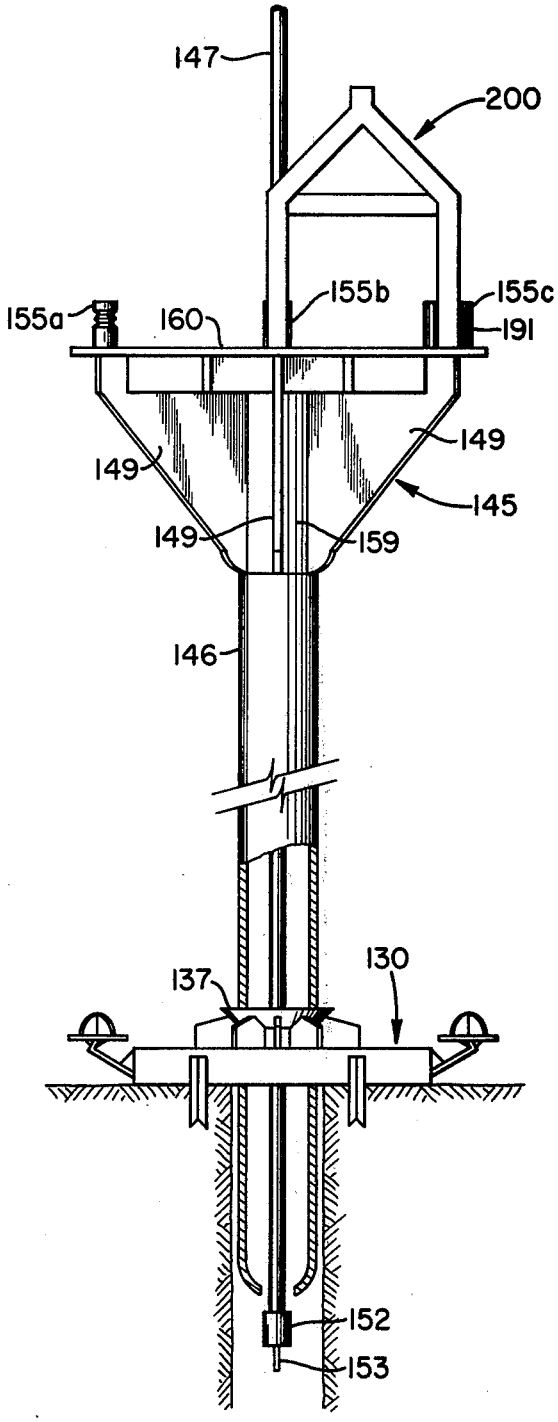
FIG. 14 is a schematic elevational view partly in section showing installation of a permanent guide base on the temporary guide base of FIG. 13 and installation of casing in the wellbore.

Referring to FIG. 14, after the well has been drilled to the desired depth, the drill bits and drill string are returned to the vessel and a permanent guide structure 145 and 42 inch casing 146 are lowered with drill pipe 147 to the temporary guide base 130. A retrievable television and sonar head 153 and a cement shoe 152 are attached to the lower end of drill pipe 147. The permanent base 145 and casing 146 are lowered until the permanent guide base rests on temporary base 130.

The guide base 145 is defined by a sleeve 159, support members 149 which are arranged about sleeve 159 to provide support for guide posts 155*a*, 155*b*, 155*c*, 155*d*, 155*e*, and 155*f* (155*d*, 155*e*, and 155*f* are not shown in view in FIG. 14), a plate 160 which provides additional support for the guide posts, and two set aside guides 200. (Only one set aside guide is in view in FIG. 14.)

After the 42 inch casing has been run into the wellbore, the casing is cemented. A 36 inch hole is then drilled to a depth of about 300 feet using a pilot bit and 36 inch underreamer. Once the 36 inch hole is drilled, 30 inch casing is run into the 42 inch casing and 36 inch hole. The 30 inch casing is then cemented.

Figure 15:
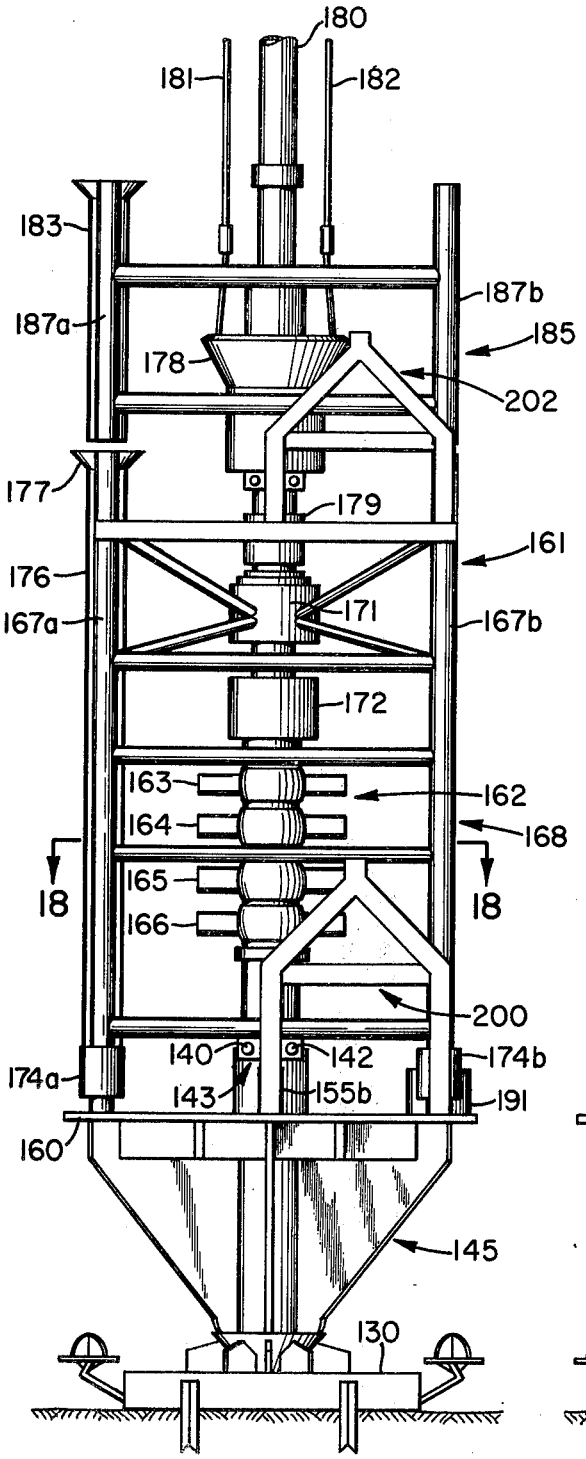
FIG. 15 is a schematic elevational view illustrating floating drilling equipment including a riser and wellhead assembly in conventional drilling position.
Figure 18:
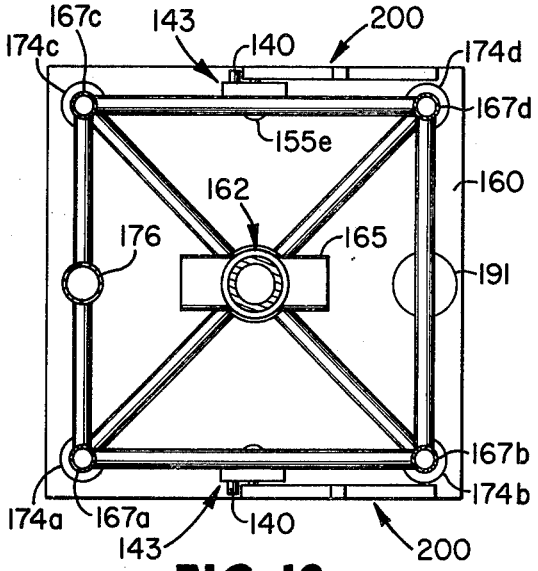
FIG. 18 is a sectional view along line 18—18 of FIG. 15 illustrating the blowout preventer assembly in conventional operating position.

After the casing is suitably cemented, a BOP assembly, identified in FIG. 15 by the numeral 161, is lowered onto permanent guide base 145 by a 14 inch riser 180. The BOP assembly is defined by frame 168, BOP stack 162, set aside guides 202, running tube 176 and hydraulic assemblies 143. The BOP frame 168 includes four support columns 167*a*, 167*b*, 167*c*, and 167*d* (FIG. 15 does not show 167*c* and 167*d*) which attach to support posts 155*a*, 155*c*, 155*d*, and 155*f* of the guide base 145 by hydraulic connectors 174. Frame 168 transmits the induced riser loads into the base 145 and casing 146, substantially reducing the load on BOP stack 162. FIG. 18, which is a sectional view along line 18—18 of FIG. 15, shows four BOP support columns 167*a*, 167*b*, 167*c*, and 167*d* connected to base 145 by hydraulic connectors 174*a*, 174*b*, 174*c* and 174*d*. The blowout preventer stack 162 includes annular blowout preventers 171 and 172, shear ram 163 and pipe rams 164, 165, and 166. Set aside frames 202 are attached to the upper end of the BOP assembly for use in setting aside the riser. The running tube 176 helps guide tools through the guide base 145 when the blowout preventer assembly is in a set aside position. The top of the running tube 176, as shown in FIG. 15, has a frustro-connical projection 177 to facilitate running of tools into the running tube. Also attached to the BOP frame are hydraulic pin assemblies 143 which house pins that are designed to extend and retract.

Figure 25:
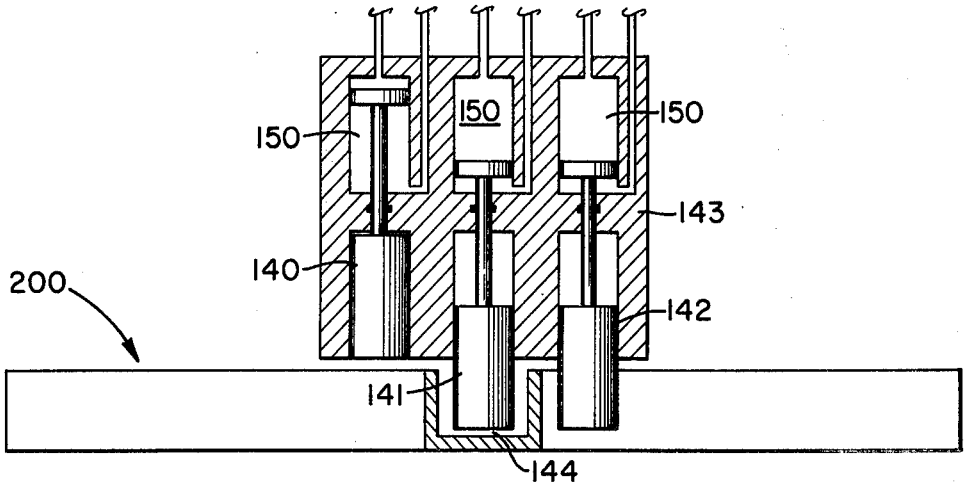
FIG. 25 is a cross-sectional view of the hydraulic pin assembly along lines 25—25 of FIG. 22.

FIG. 25 shows a horizontal sectional view of a pin assembly 143 with pins 140, 141 and 142. This sectional view is taken along lines 25—25 of FIG. 22. These pins may be extended or retracted by suitable hydraulic cylinders 150 to engage the set aside frame 200. The pin assemblies and the set aside frames 200 will be described in more detail hereinafter.

A frame 185 (shown in FIG. 15) is attached to the lower end of the marine riser 180 to provide support for equipment used in set aside of the riser. A running tube 183 and two hydraulic pin assemblies 188 are attached to the frame 185. The running tube is used in guiding tools through the BOP stack when the riser is in the set aside position. When the riser is positioned above the BOP assembly, as shown in FIG. 15, the running tube 183 is in axial alignment with the running tube 176 of the BOP stack. The pin assemblies 188 aid in setting aside the riser. The pin assemblies 188 have substantially the same design and function as the pin assemblies 143 of the BOP assembly.

Figure 16:
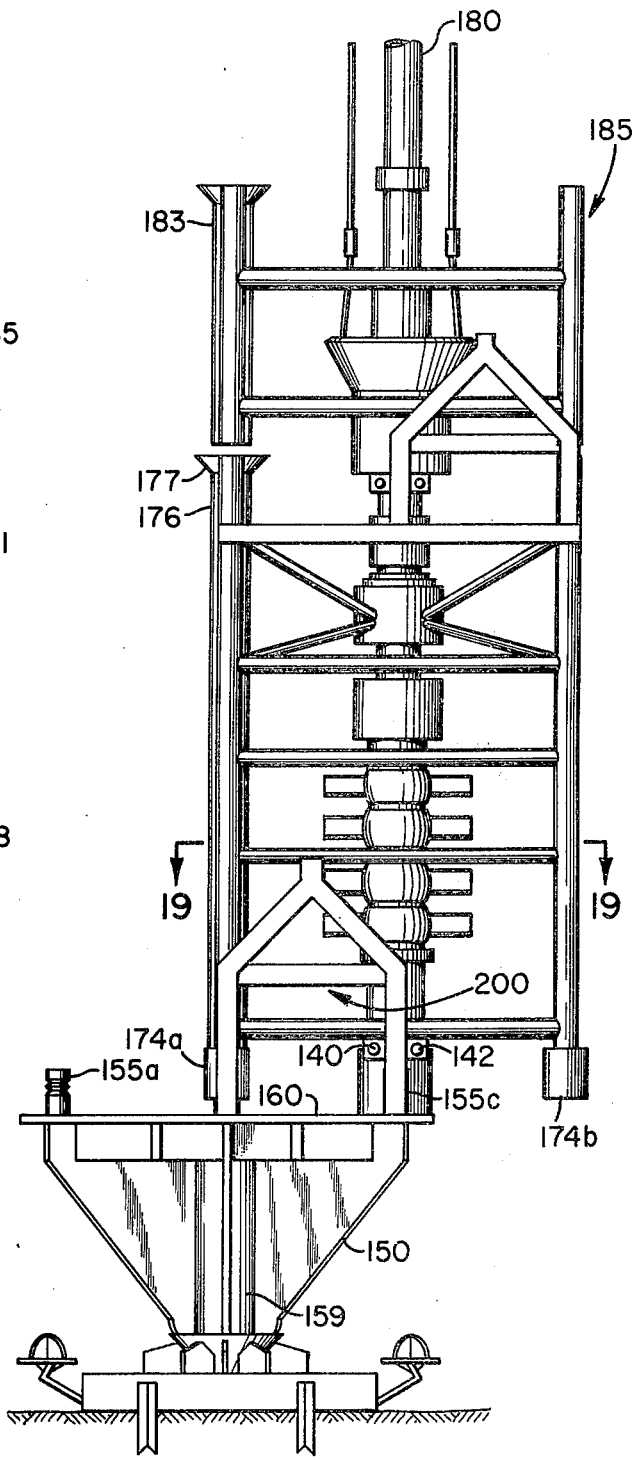
FIG. 16 is a schematic elevational view illustrating the floating drilling equipment of FIG. 15 with the riser system and a blowout preventer in the set aside position.
Figure 17:
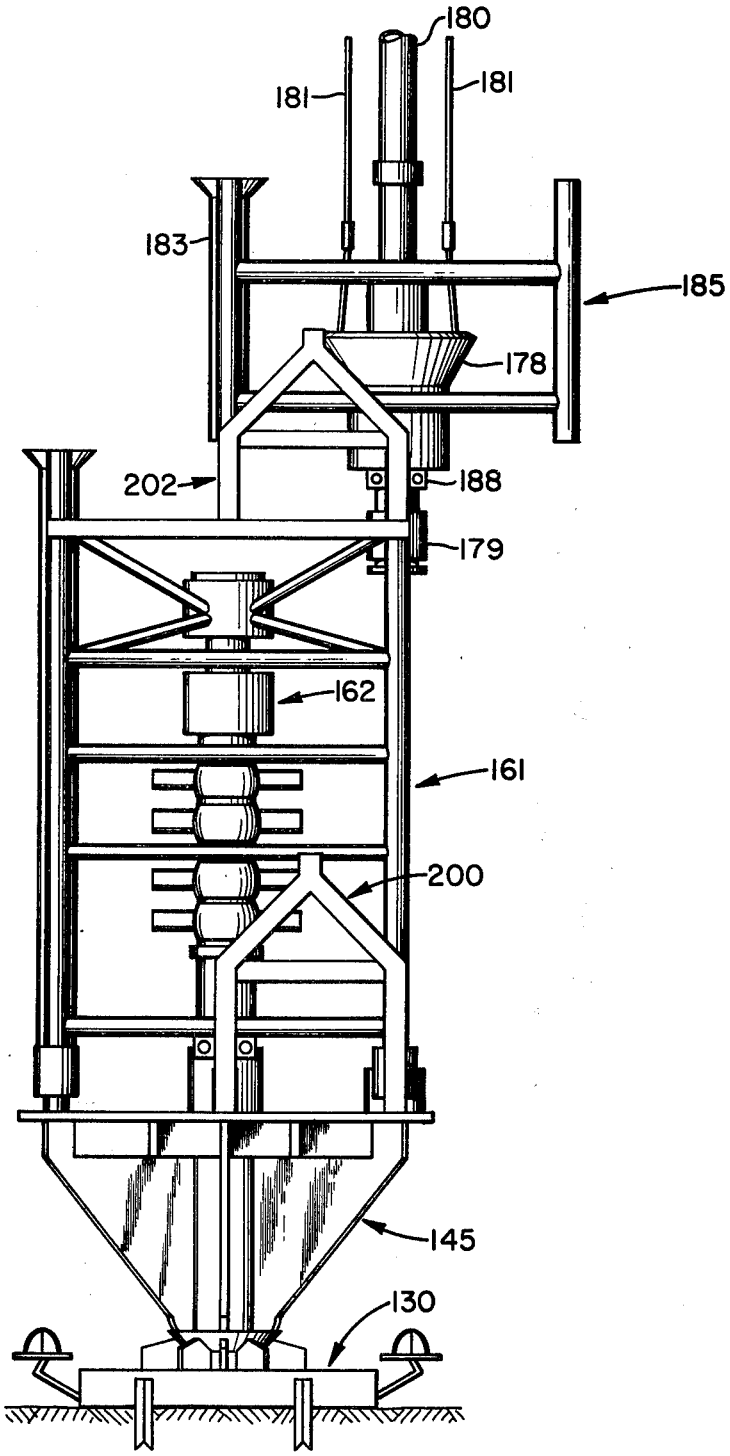
FIG. 17 is a schematic elevational view illustrating the blowout preventer in conventional operating position and the riser in a set aside position.

The riser, as shown in FIGS. 15 and 16, is in axial alignment with the BOP stack and is connected to the BOP stack by hydraulic connector 179. The riser also includes a conventional flexible joint 178 which allows the riser to flex. Conventional kill and choke lines 181 extend from the BOP stack to the floating vessel (not shown).

Once the BOP assembly is in normal operating position, as shown in FIG. 15, a 26 inch underreamer is run through the riser and wellhead assembly to drill a 26 inch hole for 20 inch casing. The term "wellhead assembly" as used herein includes temporary guide base 130, permanent guide base 145, and the BOP assembly 161. After the 26 inch hole is drilled to a depth of about 800 feet, the drill string and underreamer are returned to the vessel.

Before running 20 inch casing in the wellbore, the 14 inch riser and the 18½ inch BOP are set aside. The basic steps for setting aside the BOP assembly include detaching hydraulic connectors 174*a*, 174*b*, 174*c*, and 174*d*, extending pins 140 and 141, uplifting the riser and BOP assembly until pins 141 are in the upper position of set aside frame (shown in FIG. 24) retracting pins 140 and extending pins 142, and then lowering the riser and BOP to the position shown in FIG. 16. Means for uplifting and moving the riser may be provided by shipboard systems as previously described.

Figure 19:
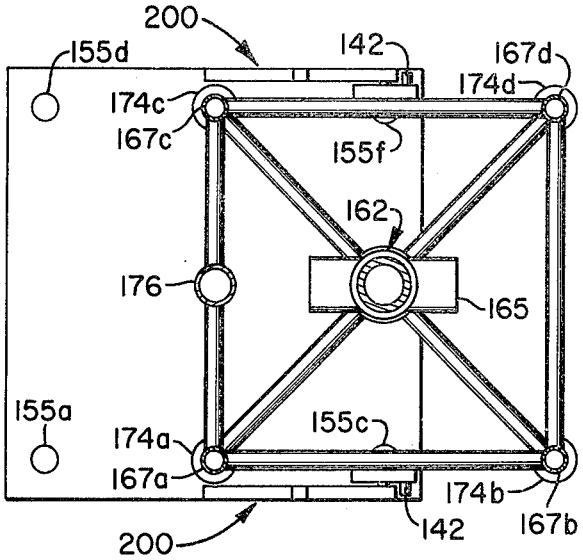
FIG. 19 is a sectional view along line 19—19 of FIG. 16 illustrating the blowout preventer assembly in the set aside position.

FIG. 18 shows the BOP and the permanent guide base 145 in conventional operating position. FIG. 19, which is a sectional view along line 19—19 of FIG. 16, shows the BOP assembly and guide base 145 when the riser and BOP are in the set aside mode. Referring to FIGS. 18 and 19, when the riser and BOP are in the set aside mode, the BOP columns 167*a* and 167*c* are attached to support post 155*b*, 155*e* by connectors 174*a* and 174*b*, and the BOP stack 162 is attached to support column 191 of the guide base 145.

Figure 20:
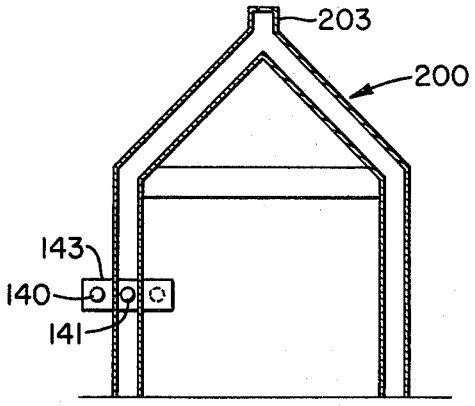
FIGS. 20–23 are vertical sectional views of a hydraulic pin assembly and set aside frame showing a sequence of steps for moving the blowout preventer and riser to the set aside position.
Figure 21:
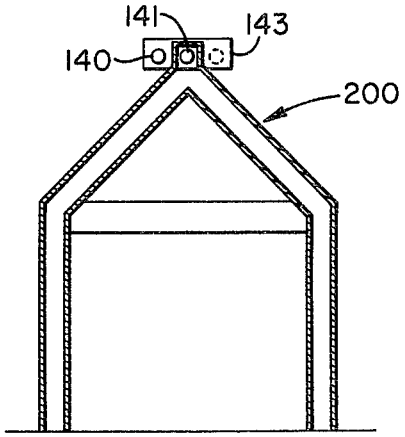
Figure 22:
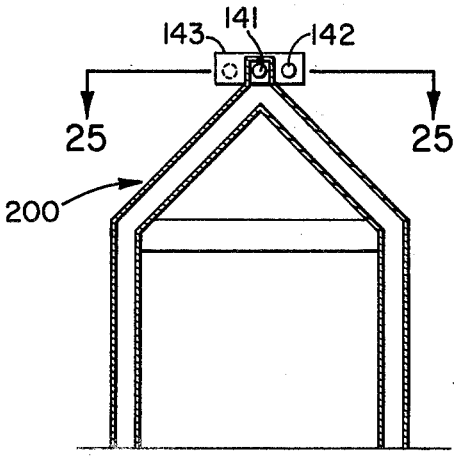
Figure 23:
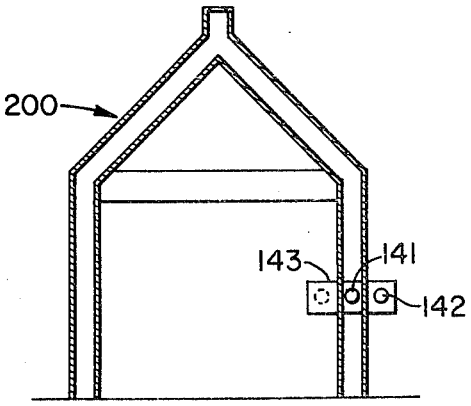
Figure 24:
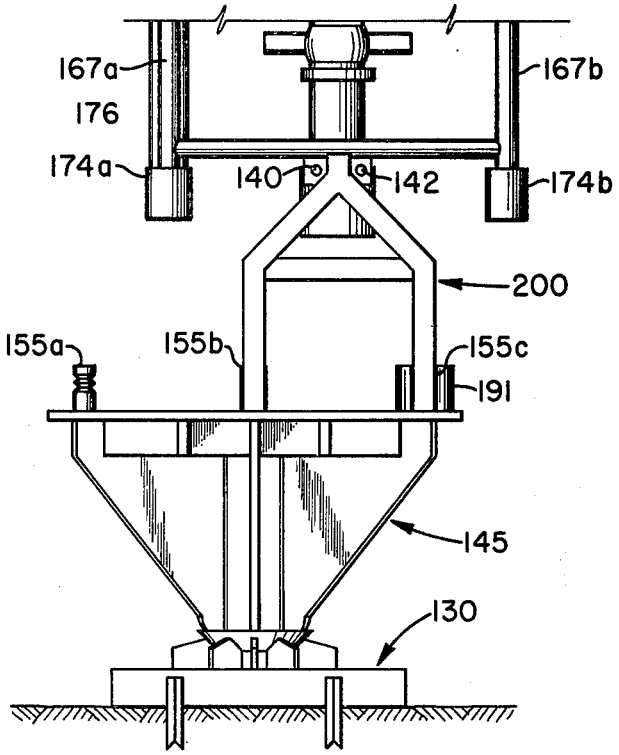
FIG. 24 is a schematic view illustrating the blowout preventer assembly being set aside.

The mechanism for moving the riser and BOP to the set aside mode may be more clearly explained by reference to FIGS. 20–23 which depict a vertical sectional view of the set aside frames 200. Referring to FIG. 20, the first step is to extend pins 140 and 141. Pins 141 are extended into groove 144 of the set aside frames. The second step is to uplift the riser and BOP until the pins 141 are at the top of slot 144 as shown in FIG. 21. The third step is to retract pins 140 and extend pins 142 as shown in FIG. 22. The BOP and riser are then lowered. Pins 142 force pins 141 down the slot 144 in the other side of the frame 200 as shown in FIG. 23.

With the riser and BOP in the set aside position, 20 inch casing can be passed through running tube 176, through the guide base 145 and into the 30 inch casing and 26 inch wellbore. The 20 inch casing is cemented in a conventional manner. Fluids displaced by the cement during the cementing operation may be returned to the vessel through conduits (not shown) which connect the riser with the casing or, if the fluids are nonpolluting, the fluids may be dumped into seawater.

After the 20 inch casing has been cemented, the BOP assembly and riser are returned to the normal operating position as depicted in FIG. 14. To return the BOP and riser assembly to this position, the riser and BOP are uplifted with the pins in the position shown in FIG. 23. Once pins 141 are at the top of the slots 144, pins 142 are retracted and pins 140 are extended. The riser and BOP are then lowered to the conventional operating position.

With the BOP in conventional operating position, drilling is continued. A 17½ inch hole for 13⅜ inch casing is drilled to a depth of about 4,000 feet. To run the 13⅜ inch casing, it is necessary to again set aside the 14 inch riser. The BOP stack, however, can remain in its conventional operating position. The steps for setting aside the riser include detaching the riser from the BOP assembly, extending suitable pins in hydraulic assembly 188 to engage set aside guides 202, uplifting the riser, retracting suitable pins in assembly 188 when the pins are at the top of the slot in the frames 202, lowering the riser to the position shown in FIG. 17 and attaching to the BOP assembly. Pins of the hydraulic assembly 188 engage set aside frames 202 in the same manner as previously described for set aside of the BOP assembly. When the riser is in the set aside positon (shown in FIG. 17), the running tube 183 of the riser frame 185 is in axial alignment with the BOP stack. After the 13⅜ inch casing is run and cemented, the riser is returned to the position shown in FIG. 15. Drilling is then continued in a conventional manner. The riser does not need to be set aside again because casing and tools used in further drilling will pass through the riser and the wellhead assembly.

It will be apparent from the foregoing that the present invention offers significant advantages over deep water riser systems previously known in the art. While the present invention has been described primarily with regard to the foregoing embodiments, it should be understood that the present invention cannot be deemed limited thereto but rather must be construed as broadly as all or any equivalents or combinations thereof.

What is claimed is:

1. A riser system extending from a floating drilling vessel to a subsea well having a wellhead comprising
   a substantially vertical riser pipe having its upper end supported on said vessel;
   subsea support means positioned in the vicinity of said wellhead, the lower end of said riser being supported by said support means;
   means for moving the lower end of the riser between a first position on said support means and a second position on said support means so that the riser in the first position is in axial alignment with the wellhead and the riser in the second position is laterally removed from axial alignment with the wellhead; and
   means aboard said vessel for maintaining the riser pipe in tension.

2. Apparatus defined in claim 1 wherein said wellhead has attached thereto a blowout preventer stack.

3. Apparatus defined in claim 1 wherein said subsea support means includes a frame which provides structural support for said riser pipe.

4. Apparatus defined in claim 3 wherein said means for moving said riser includes guidance means interconnecting the lower end of said riser and said frame.

5. Apparatus defined in claim 4 wherein said guidance means includes hydraulically actuated lifting means.

6. Apparatus defined in claim 1 which further includes fluid communication means between said subsea wellhead and said subsea support means.

7. Apparatus defined in claim 6 wherein said fluid communication means includes a diverter pipe which diverts fluid from said wellhead to said subsea support means.

8. A riser system for interconnecting a subsea wellhead and a floating vessel comprising:
   (a) a substantially vertical riser pipe having its upper end supported on said vessel and its lower end detachably connected to said wellhead;
   (b) subsea support means for supporting said lower end of the riser, the support means positioned adjacent said wellhead;
   (c) means for detaching the lower end of said riser pipe from said wellhead;
   (d) means for moving said riser pipe so that the lower end of said riser pipe can be placed in supporting relationship with said subsea support means;
   (e) means for returning the lower end of said riser pipe from subsea support means to said wellhead; and
   (f) means aboard said vessel for maintaining tension in the riser pipe with the riser pipe in supporting relationship with said support means.

9. Apparatus defined in claim 8 wherein said wellhead has attached thereto a blowout preventer stack.

10. Apparatus defined in claim 8 wherein said subsea support means includes a frame which can provide structural support for said riser pipe.

11. Apparatus defined in claim 8 wherein said means for detaching the lower end of said riser pipe includes hydraulic connectors.

12. Apparatus defined in claim 8 wherein said means for moving said riser pipe includes guidance means attached to the lower end of said riser pipe.

13. Apparatus defined in claim 8 which further includes fluid communication means between said subsea wellhead and said subsea support means.

14. Apparatus defined in claim 13 wherein said fluid communication means includes a diverter pipe which diverts fluid from said wellhead to said subsea support means.

15. A riser system for interconnecting a subsea wellhead and a floating vessel comprising:
   (a) a substantially vertical riser pipe having its upper end supported on said vessel and its lower end detachably connected to said wellhead;
   (b) subsea support means for supporting said lower end of the riser, the support means positioned adjacent said wellhead;
   (c) means for detaching the lower end of said riser pipe from said wellhead;
   (d) means for moving said riser pipe so that the lower end of said riser pipe can be placed in supporting relationship with said subsea support means, said means for moving said riser pipe includes tensioning means aboard said floating vessel which attaches to the upper end of said riser pipe and which maintains said riser in tension; and
   (e) means for returning the lower end of said riser pipe from subsea support means to said wellhead.

16. Apparatus defined in claim 15 wherein said tensioning means further includes means which are adapted with said tensioning means to permit the lateral movement of the upper end of said riser pipe.

17. In a method of conducting deep water well operations from a floating drilling vessel wherein a riser pipe is attached at its upper end to said floating vessel and at its lower end to a subsea wellhead, the improvement comprising:
   (a) detaching the lower end of said riser pipe from said subsea wellhead;
   (b) laterally moving said riser pipe so that the lower end of said riser pipe is positioned a distance from said subsea wellhead;
   (c) lowering casing into the well, said casing having a larger outside diameter than the inside diameter of the riser pipe; and
   (d) maintaining said riser pipe in tension with said riser pipe positioned said distance from said subsea wellhead.

18. In a method of conducting deep water well operations from a floating drilling vessel wherein a riser pipe is attached at its upper end to said floating vessel and at its lower end to a blowout preventer stack, said blowout preventer stack positioned above and attached to a subsea wellhead, the improvement comprising:
   (a) detaching the lower end of said blowout preventer stack from said subsea wellhead;
   (b) laterally moving said riser pipe with said blowout preventer stack attached thereto so that the lower end of said riser pipe and said blowout preventer stack are positioned a distance from said subsea wellhead; and
   (c) lowering casing into the well, said casing having a larger outside diameter than the inside diameter of the riser pipe.

19. A wellhead assembly for a subsea well which comprises
   a frame having first support means adapted to support the lower end of a marine riser in a position which is in general axial alignment with said well and second support means adapted to support the lower end of a marine riser in a position laterally removed from the axially aligned position, thereby permitting the introduction of tools into said well by bypassing said marine riser; and means for moving said riser between said axially aligned and laterally removed positions.

20. A wellhead assembly positioned on the floor of a body of water and connected to a floating vessel by a riser, which comprises support means for supporting the lower end of the riser in a first position and then in a second position, said support means with the riser in the first position being adapted to permit the lowering of equipment through the riser and into the well, and said support means with said riser in the second position being adapted to permit the lowering of the equipment into the well without passing through the riser; and means for moving the riser between said first position and said second position.

21. A wellhead assembly for use in well operations positioned on the floor of a body of water and connected to a floating vessel by a riser, which comprises a blowout preventer assembly attached to the lower end of the riser;

guide means attached to the blowout preventer assembly for guiding the lower end of the riser between a first position and a second position, the riser in said second position being in axial alignment with the well and the riser in said second position being laterally removed from the axis of said well;

a support means positioned below the blowout preventer for supporting the blowout preventer assembly; and a guide means attached to the support means for guiding the blowout preventer assembly between a first position and a second position, the blowout preventer in the first position being in axial alignment with the well and the blowout preventer in the second position being laterally removed from the axis of said well.

22. In a method of conducting deep water well operations from a floating drilling vessel wherein a riser pipe is attached at its upper end to said floating vessel and at its lower end to a subsea support means positioned adjacent a subsea wellhead, the improvement comprising:

(a) maintaining said riser pipe in tension with said riser pipe attached to said support means;

(b) detaching the lower end of said riser pipe from said subsea support means;

(c) laterally moving said riser pipe to a position which is in axial alignment with said subsea wellhead; and (d) attaching the lower end of said riser pipe to said subsea wellhead.

23. Method defined in claim 22 wherein said subsea wellhead has attached thereto a blowout preventer stack.

24. Method defined in claim 22 wherein said subsea support means includes a frame which can provide structural support for said riser pipe.

25. In a method of conducting deep water well operations from a floating drilling vessel wherein a riser pipe is attached at its upper end to said floating vessel and at its lower end to a subsea support means positioned adjacent a subsea wellhead, the improvement comprising:

(a) detaching the lower end of said riser pipe from said subsea support means;

(b) laterally moving said riser pipe to a position which is in axial alignment with said subsea wellhead;

(c) attaching the lower end of said riser pipe to said subsea wellhead;

(d) detaching the lower end of said riser pipe from said subsea wellhead;

(e) returning said riser pipe to a position which is in supporting relationship with said subsea support means; and (f) reattaching the lower end of said riser pipe to said subsea support means.

26. Method defined in claim 25 which further includes the steps of detaching the upper end of said riser pipe from said floating vessel and moving the upper end of said riser pipe a distance away from said floating vessel.

27. Method defined in claim 26 which further includes the step of attaching said upper end of said riser pipe to a workboat vessel which is positioned a distance away from said floating vessel.

28. The method defined in claim 26 wherein said riser has been made sufficiently buoyant to permit it to be self standing after it has been detached from said floating vessel.

29. The method defined in claim 28 wherein said upper end of said riser is secured at a distance away from said floating vessel by the use of anchoring means.

30. In a method of conducting deep water well operations from a floating vessel wherein a riser pipe is attached at its upper end to a floating vessel and at its lower end to a subsea wellhead, and wherein a drill string extends through said riser pipe into said wellhead to perform drilling operations, the improvement comprising:

(a) withdrawing said drill string from said subsea wellhead and said riser pipe;

(b) detaching the lower end of said riser pipe from said subsea wellhead;

(c) laterally moving said riser pipe to a position which aligns in a supporting relationship with a subsea support means positioned adjacent said subsea wellhead, and (d) attaching the lower end of said riser pipe to said subsea support means.

31. Method defined in claim 30 which further includes running casing having a diameter larger than the inside diameter of said riser pipe into said subsea wellhead.

32. Method defined in claim 30 which further includes providing fluid communication between said riser pipe and said subsea wellhead after said riser pipe has been connected to said subsea support means.

33. Method defined in claim 30 wherein fluid communication between said riser pipe and said wellhead is provided by a diverter pipe which diverts fluid from said wellhead to said subsea support means.

34. Method defined in claim 30 which further includes extending a drill string having a drill bit attached thereto into said subsea wellhead, said drill bit having a diameter greater than the diameter of said riser pipe.

35. In a method of conducting deep water well operations from a floating vessel wherein a riser pipe is attached at its upper end to said floating drilling vessel and at its lower end to a subsea wellhead, the improvement comprising:

(a) detaching the lower end of said riser pipe from said subsea wellhead;

(b) laterally moving said riser pipe to a position which is in supporting relationship with a subsea support means positioned adjacent said subsea wellhead;

(c) attaching the lower end of said riser pipe to said subsea support means; and (d) maintaining tension in said riser pipe with said riser pipe attached to said subsea support means.

36. Method defined in claim 35 wherein said wellhead has attached thereto a blowout preventer stack.

37. Method defined in claim 35 wherein said subsea support means includes a frame which can provide structural support for said riser pipe.

38. A method of performing drilling operations in a well from a floating drilling vessel through a subsea wellhead comprising:

(a) lowering a low pressure blowout preventer stack to said wellhead and attaching said low pressure stack to said wellhead;

(b) supporting a riser pipe from said drilling vessel, the lower end of said riser pipe being laterally removed from the axis of said wellhead and in fluid communication with said wellhead;

(c) lowering a drilling string from said vessel through said low pressure stack and wellhead;

(d) drilling a portion of said well including circulating drilling fluid downwardly through said drill string into said well and returning said fluid to said vessel through said riser pipe;

(e) withdrawing said drill string from said wellhead;

(f) lowering casing into the drilled portion of said well;

(g) removing said low pressure stack from said wellhead;

(h) lowering a high pressure blowout preventer stack to said wellhead and attaching said high pressure stack to said wellhead;

(i) moving the lower end of said riser pipe into axial alignment with said high pressure stack and attaching the riser pipe to said high pressure stack;

(j) lowering a drill string from said vessel through said riser pipe, high pressure stack and wellhead; and (k) drilling the remaining portion of said well.

39. A method for performing drilling operations in a well from a floating drilling vessel through a base structure positioned on the bottom of the body of water which comprises lowering a blowout preventer stack to said base structure and attaching said blowout preventer stack to said base structure;

supporting a riser pipe from said drilling vessel, the lower end of said riser pipe being attached to the blowout preventer stack;

lowering a drilling string from said vessel through said riser and said blowout preventer stack;

drilling a first portion of said well;

withdrawing said drilling string from said base structure;

detaching the blowout preventer from the base structure and moving the blowout preventer laterally from the axis of the well;

lowering casing through said base structure and into the drilled portion of the well;

moving the blowout preventer into axial alignment with said well and attaching the blowout preventer to the base structure;

lowering a drill string from said vessel through said riser pipe and blowout preventer stack;

drilling a second portion of said well;

withdrawing said drill string from said blowout preventer stack;

detaching the riser from the blowout preventer stack;

moving the lower end of the riser laterally from the axis of the blowout preventer stack;

lowering casing into the second portion of the well;

moving the lower end of the riser into axial alignment with the blowout preventer stack and attaching the riser to said blowout preventer stack; and drilling the remaining portion of said well.

40. In a method of conducting deep water well operations from a floating vessel wherein a riser pipe is attached at its upper end to said floating drilling vessel and at its lower end to a subsea wellhead, the improvement comprising:

(a) detaching the lower end of said riser pipe from said subsea wellhead;

(b) laterally moving said riser pipe to a position which is in supporting relationship with a subsea support means positioned adjacent said subsea wellhead;

(c) attaching the lower end of said riser pipe to said support means;

(d) detaching the lower end of said riser pipe from said subsea support means;

(e) laterally moving said riser pipe to return it to a position which is in axial alignment with said subsea wellhead; and (f) reattaching the lower end of said riser pipe to said subsea support means.

* * * * *

UNITED STATES PATENT OFFICE

CERTIFICATE OF CORRECTION

PATENT NO. : 4,147,221

DATED : April 3, 1979

INVENTOR(S) : William T. Ilfrey, Joe K. Heilhecker, Leo D. Maus

It is certified that error appears in the above-identified patent and that said Letters Patent are hereby corrected as shown below:

Column 15, line 29 for the Claim 21, "second" should read --first--

Signed and Sealed this

*Nineteenth* Day of *February 1980*

[SEAL]

*Attest:*

SIDNEY A. DIAMOND

*Attesting Officer*

*Commissioner of Patents and Trademarks*